US007451731B2

(12) United States Patent
Eichenberg et al.

(10) Patent No.: US 7,451,731 B2
(45) Date of Patent: Nov. 18, 2008

(54) CAMSHAFT ADJUSTING DEVICE

(75) Inventors: Andreas Eichenberg, Chemnitz (DE); Matthias Gregor, Stuttgart (DE); Jens Meintschel, Esslingen (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 11/651,408

(22) Filed: Jan. 9, 2007

(65) Prior Publication Data

US 2007/0144476 A1 Jun. 28, 2007

Related U.S. Application Data

(63) Continuation-in-part of application No. PCT/EP2005/006787, filed on Jun. 23, 2005.

(30) Foreign Application Priority Data

Jul. 14, 2004 (DE) ..... 10 2004 033 894

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,328,008 B1 12/2001 Io
6,499,452 B2 * 12/2002 Ma ..... 123/90.17

FOREIGN PATENT DOCUMENTS

| | | |
|---|---|---|
| DE | 36 07 256 | 9/1987 |
| DE | 100 22 690 | 5/2001 |
| DE | 100 54 796 | 6/2001 |
| DE | 101 16 300 | 10/2002 |
| DE | 102 47 650 | 4/2003 |
| EP | 1 065 348 | 1/2001 |
| JP | 02 011809 | 1/1990 |
| WO | WO 01/88344 | 11/2001 |
| WO | WO 2006/005406 | 1/2006 |

* cited by examiner

*Primary Examiner*—Zelalem Eshete
(74) *Attorney, Agent, or Firm*—Klaus J. Bach

(57) ABSTRACT

In a camshaft adjusting device for adjusting a phase position of a camshaft relative to a crankshaft of an internal combustion engine with a gear mechanism including at least three drive connections, a locking element is provided, with which at least two of the at least three drive connections, can be locked to one another in a rotationally fixed manner depending on operating conditions for retaining a particular phase position of the camshaft relative to the crankshaft of the internal combustion engine.

19 Claims, 6 Drawing Sheets

CAMSHAFT ADJUSTING DEVICE

This is a Continuation-In-Part Application of pending International Patent Application PCT/EP2005/006787 filed Jun. 23, 2005 and claiming the priority of German patent application 10/2004 033 894.9 filed Jul. 14, 2004.

BACKGROUND OF THE INVENTION

The invention relates to a camshaft adjusting device, in particular a passive camshaft adjusting device of an internal combustion engine with at least three shafts and a gear mechanism.

It is known to change the phase position of a camshaft of an internal combustion engine by passive, i.e. driveless camshaft adjusting devices. These devices comprise, for example, a brake and a lever mechanism, as it is known from Laid-open specification DE 102 47 650 A1. The variable moment of the brake at the control input of the adjusting gear mechanism of the camshaft adjusting device leads to the change of the phase position of the camshaft. Application of the brake causes the control shaft to slow down so as to change the phase position to advance valve timing, for example, via a negative gear mechanism. If the brake is released, the control input accelerates because of the load moment of the camshaft, and the phase position is changed to retard the valve timing. At a constant phase position, the control shaft has to be kept to the rotational speed of the camshaft in such a manner that no relative movement in the adjusting gear mechanism is possible.

During startup of the internal combustion engine, at low rotational speeds and when the brake fails, the camshaft adjusting device has to be locked in a position customarily situated between end stops. Locking is also desirable in the event of failure of parts of the system, such as the brake, the control unit, the contact connection means, the sensor technology and the like, in order to permit emergency operation of the vehicle.

It is the principle object of the present invention to provide a camshaft adjusting device with which reliable locking of the camshaft adjusting device is possible in a cost-effective manner.

SUMMARY OF THE INVENTION

In a camshaft adjusting device for adjusting a phase position of a camshaft relative to a crankshaft of an internal combustion engine with a gear mechanism including at least three drive connections, a locking element is provided, with which at least two of the at least three drive connections, can be locked to one another in a rotationally fixed manner depending on operating conditions for retaining a particular phase position of the camshaft relative to the crankshaft of the internal combustion engine.

The locking of two drive connections also fixes the rotational speed of the third drive connection. A hysteresis brake and the activation thereof can advantageously then be smaller, since, in the event of cold starting at low temperatures, a load moment of the camshaft does not solely have to be compensated for by the hysteresis brake or the camshaft adjusting device. Furthermore, control of the camshaft adjusting device during starting and warm-up of the internal combustion engine is simplified, since changing moments of the camshaft at low rotational speeds can otherwise difficult to control. When the internal combustion engine is switched off, the camshaft adjusting device can advantageously be moved into a position which is required for a subsequent starting, and can be locked in that position.

The locking element is expediently connected to one of the drive connections or shafts in a rotationally locked manner, preferably to the control input structure, the control input structure being formed by a support member of a hysteresis band of the hysteresis brake.

In an advantageous embodiment, the locking element connects a control input of a gear mechanism to a drive in a rotationally locked manner. The locking element can optionally connect a control input of the gear mechanism to the camshaft in a rotationally locked manner or, alternatively, can connect a drive of the camshaft to the camshaft in a rotationally locked manner. The two shafts can be connected, preferably with a form fit, by the locking element. A frictional connection of the two shafts is also conceivable if required spring forces and/or magnetic forces are available for the locking and/or unlocking. If this is the case, the camshaft adjusting device can be locked in every position.

Preferably, for locking in a latching position, the locking element can be moved into a catch of one of the two other shafts. As a result, the shaft to which the locking element is connected in a rotationally locked manner, and the shaft on which the catch is arranged are connected rigidly to each other at least with a form fit. In this case, the locking element can be moveable in the radial direction between a locking position and an unlocking position. The locking element can preferably be moved by means of a magnetic force of a hysteresis brake present and/or by means of a centrifugal force.

The locking element is preferably at least partially formed from magnetic material with a relative magnetic permeability of more than 1, for example iron. The locking element can then be moved advantageously by the action of a magnetic field. In a favorable embodiment, the locking element is at least partially formed from a permanently magnetic material. If the connecting element is moved by a magnetic circuit of a hysteresis brake, an active activation of the locking element is not required. The costs of the camshaft adjusting device can be lowered. The force action of the permanent magnet can reduce a required current in a coil which is assigned to the hysteresis brake and is necessary in order to hold the locking element in the unlocked position.

A plurality of latching points are preferably provided on the shaft for the locking, i.e. a plurality of catches are correspondingly arranged on the shaft, into which the locking element can latch. Advantageously, individual latching points can be selected depending on operating conditions. A favorable position can thus be set specifically, for example, for engine startup or for emergency operation.

If the locking element can be moved in the radial direction with respect to the axis of rotation of the shafts between a locking position and an unlocking position, locking can take place outside a stator gap of the hysteresis brake, which gap is provided with a pole structure.

Alternatively, the locking element can be moveable in the axial direction with respect to the axis of rotation of the shafts between a locking position and an unlocking position. The locking element is preferably arranged in such a way that it can be moved axially back and forth in the direction of a stator gap of the hysteresis brake by means of a magnetic field. In this case, the locking element can be lockable outside the pole structure of the hysteresis brake, with the locking element, in its unlocking position, not engaging in the stator gap in practice. However, the locking element may also be arranged such that it can be moved back and forth essentially within the stator gap provided with the pole structure of the hysteresis brake, and can be drawn into the stator gap by magnetic force.

In this case, a restoring spring is expediently provided in the stator gap, which restoring spring, as the magnetic force weakens, pushes the locking element out of the stator gap for the locking.

In a favorable alternative arrangement, the locking element is pivotable about a rotary joint between a locking position and an unlocking position. The rotary joint is preferably arranged in such a manner that its pivot axis lies in the plane of the rotor cross section of the rotor support of the hysteresis brake.

A restoring spring is expediently provided in order to move the locking element from an unlocking position into a locking position. If the locking element is unlocked by magnetic force, in particular from a hysteresis brake, the restoring spring ensures that, as the magnetic force weakens or disappears, the locking element couples the two shafts to each other in a rotationally locked manner. If the current fails or if there is a defect in the control system, the vehicle can therefore continue to be operated in emergency operating mode at a constant phase position of the camshaft adjusting device.

In an advantageous development, the locking element can be held in an unlocking position by a magnetic flux of a hysteresis brake. As a result, a coil assigned to the hysteresis brake can be used at the same time for magnetic actuation of the locking element. Additional components for active activation of the locking element are unnecessary.

In a favorable refinement, a separate solenoid can be provided at low additional costs in order to actuate the locking element. It is particularly construction-space-saving to integrate the stator of the further solenoid in the stator of the hysteresis brake. The solenoid is advantageously arranged radially outside a hysteresis brake band of the hysteresis brake. In this case, the locking element can be moveable radially between a locked and an unlocked position or else, as described above, can be moveable in the axial direction in a stator gap, preferably the stator gap of the further solenoid.

The solenoid and the hysteresis brake can have a common electric power supply unit. Both coils of the solenoid can be connected electrically in parallel or, alternatively, in series. It is likewise conceivable to provide the further solenoid with a separate power supply.

In a further advantageous development, the locking element is arranged in such a manner that it is moveable radially by the action of centrifugal force. This arrangement is advantageous if the camshaft adjusting device is to be unlocked only above a certain rotational speed and is to be locked again if the rotational speed drops below it. In addition, a magnetic force can be used for the locking together with the means described above. In principle, however, in this arrangement, magnetic force assistance may also be entirely omitted. The rotational speed, above which the camshaft adjusting device is to be unlocked can be pre-determined in a simple manner by the corresponding geometrical configuration of the camshaft adjusting device and the components thereof, in particular the spring force of the restoring spring.

The invention will be described in greater detail below on the basis of an exemplary embodiment with reference to the accompanying drawings.

DESCRIPTION OF VARIOUS EMBODIMENTS

Figure 1A:
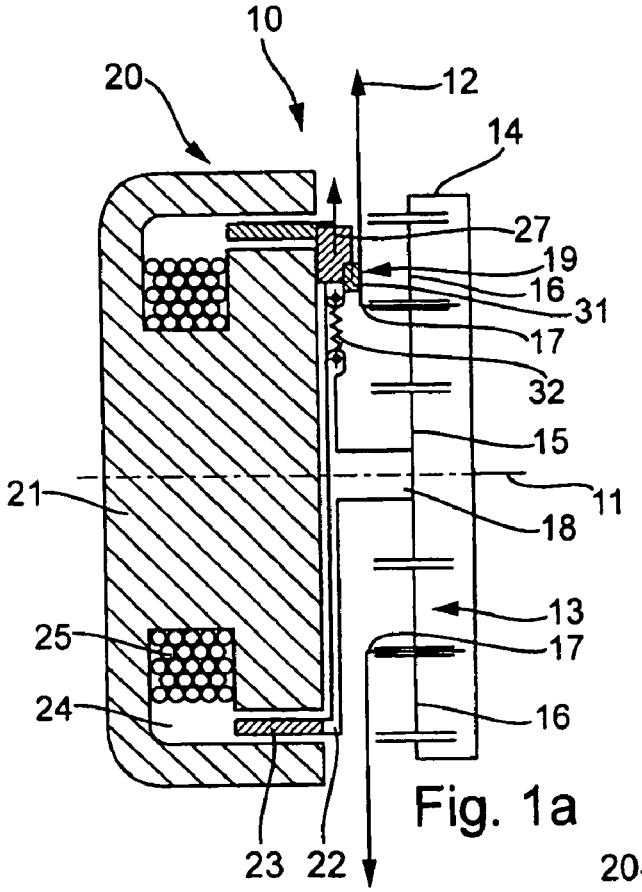
FIGS. 1*a,* and 1*b* show a locking element, which is moveable radially in a stator of a hysteresis brake by means of magnetic flux, in a locked position (a) and an unlocked position (b)

The exemplary embodiments described in more detail in FIGS. 1-8 below show a preferred camshaft adjusting device 10 for adjusting a phase position of a camshaft 11 with a gear mechanism 13 designed as a summing gear mechanism. The camshaft adjusting device 10 has three shafts: a control input 18, a drive 12 and an output which is formed by the camshaft 11. The gear mechanism 13 is designed as a single-stage planetary gear mechanism, in which the camshaft 11 is arranged on a ring gear 14, a drive 12 designed as a chain wheel is arranged on planet carriers 17 with planets 16 and with a control input 18 on a sun wheel 15. The gear mechanism 13, which is used by way of example, will not be discussed in more detail below. Other types of gear mechanisms may also be provided. The camshaft adjusting device 10 operates passively with a hysteresis brake 20.

A rotor 22 of the hysteresis brake 20 is arranged at the control input 18, a coil 25 forming a solenoid being arranged in the stator 21 of the hysteresis brake and a hysteresis band 23, which is connected fixedly to the rotor 22, being moveable rotatably in the stator gap 24 of the hysteresis brake. The hysteresis band 23 rotates about the same axis of rotation as the camshaft 11, the axis of rotation being shown as an axis of symmetry by broken lines. A magnetic pole structure (not illustrated) is formed at the stator gap 24 and, when the coil 25 is energized, induces a magnetic flux in the hysteresis band 23 and, upon appropriate energization of the coil 25, serves in a manner known per se to actuate the brake. In the figures, identical elements or elements remaining essentially the same are in principle numbered with the same reference numbers.

Figure 1B:
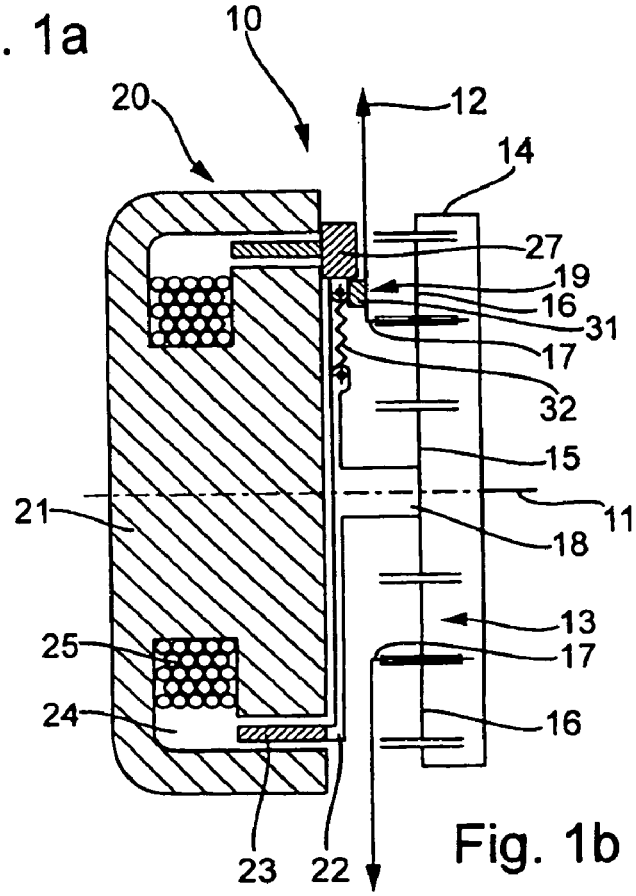

A first exemplary embodiment can be seen from FIGS. 1*a* and 1*b,* in which a locking element 27 is arranged outside a stator gap 24 of the hysteresis brake 20, which gap is provided with a pole structure. The locking element 27, which is at least partially composed of magnetic material, slides in the rotor 22 of the hysteresis brake 20 and, when the coil 25 of the hysteresis brake 20 is energized, is drawn by the magnetic force thereof into the stator gap 24. The locking element 27 is connected to the rotor 22 in a rotationally locked manner. A restoring spring 32 draws the locking element 27 in the direction of a catch 31, which is arranged at the input of the camshaft adjusting device 10 at a latching point 19 of the drive 12, which is designed here as a chain wheel. The catch 21 may alternatively also be connected to the camshaft 11, and a plurality of latching points 19 may be provided.

When the spring force of the restoring spring 32 is greater than the magnetic force of the coil 25, or of the associated solenoid, and the catch 31 and the locking element 27 are in the correct position with respect to each other, the locking element 27 enters the catch 31 and therefore connects the rotor shaft of the rotor 22, which rotor shaft forms the control input 18 of the gear mechanism 13, and the drive 12, which is designed as a chain wheel and forms the input of the gear mechanism 13, to each other in a rotationally fixed manner. This corresponds to the coupling situation illustrated in FIG. 1*a*. The gear mechanism 13 is therefore blocked, and the phase position of the camshaft adjusting device 10 remains constant. The action of the magnetic force is indicated by an upwardly directed arrow on the locking element 27. The unlocked position of the locking element 27 is illustrated in FIG. 1*b*. When the coil 25 is sufficiently energized, the locking element 27 is displaced radially outward and is held there until the magnetic force becomes lower than the spring force of the restoring spring 32. The locking element 27 no longer engages in the catch 31. Drive 12 and rotor 22 are no longer coupled rigidly.

If, during operation, the camshaft adjusting device 10 is in a switching-off or emergency operating position, a certain minimum current has to flow through the coil 25 of the hysteresis brake 20, so that the locking element 27 does not move into the catch 31. Although in all other positions outside the latching point 19 or the latching points 19 the restoring spring 32 leads to entry of the locking element 27 if the hysteresis brake 20 is energized at too low a level or not at all, latching is then not possible.

Figure 2:
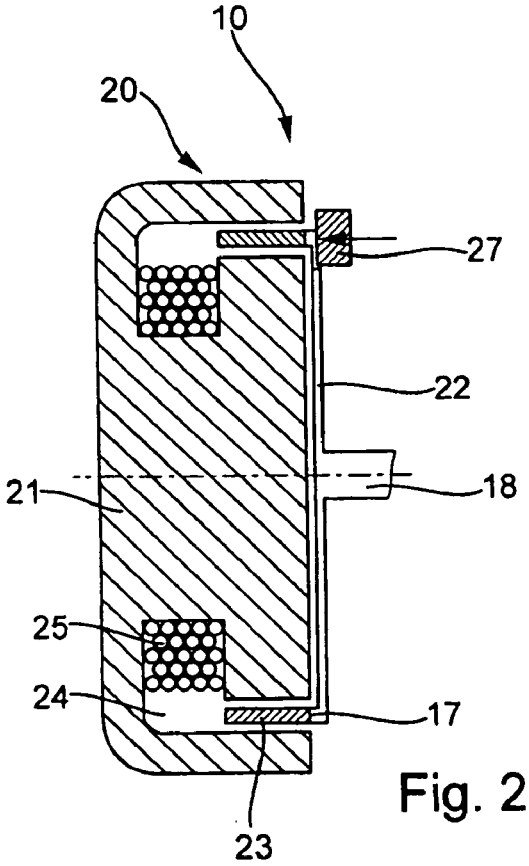
FIG. 2 shows a locking element which is moveable axially in the rotor of a hysteresis brake by means of a magnetic flux of the hysteresis brake, FIGS. 3*a,* 3*b,* 3*c* show a locking element, which is arranged pivotably in the rotor of a hysteresis brake, with direction of movement indicated (a), as a three-dimensional overall view from the front (b) and a view of the isolated locking element in the unlocked position (c)

FIG. 2 illustrates a preferred exemplary embodiment, in which a locking element 27 is arranged axially outside a stator gap 24 of the hysteresis brake 20, and a pole structure extending into the gap 24. The gear mechanism 13 is not explicitly illustrated. An arrow, which is directed into the stator gap 24, on the locking element 27 indicates the direction of the magnetic force when the coil 25 of the hysteresis brake 20 is energized. The locking element 27 is attached moveably to the rotor 22 of the hysteresis brake 20. For the locking, the locking element 27 can be disengaged in the opposite direction and latches, for example in the axial direction, into a catch (not illustrated).

Figure 3A:
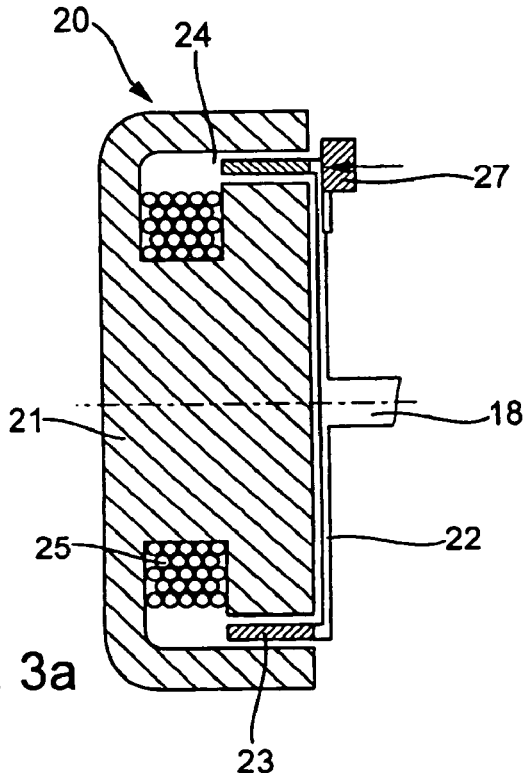
Figure 3B:
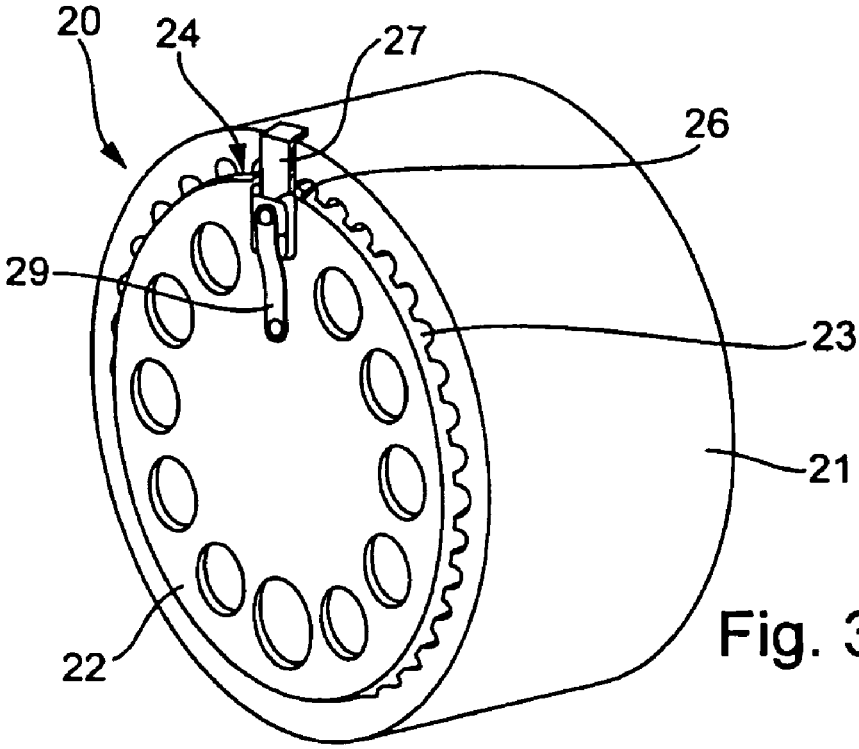
Figure 3C:
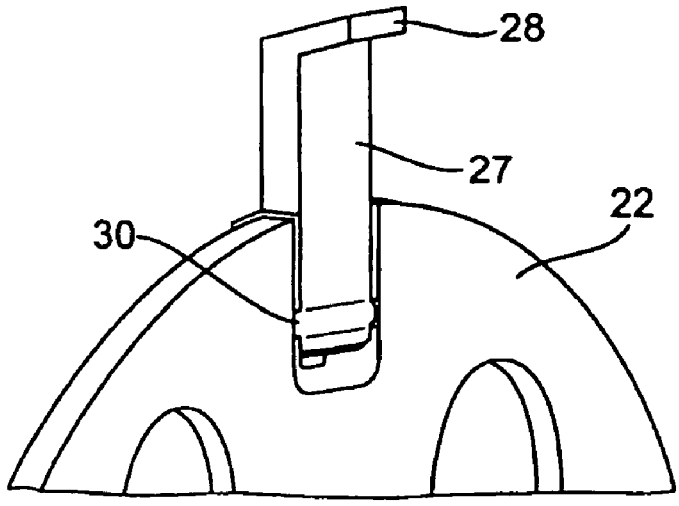

FIGS. 3*a*, 3*b*, 3*c* sketch a further preferred exemplary embodiment, in which the locking element 27, which is arranged pivotably in the rotor 22, can be pivoted in the direction of the rotor gap 24 in the stator 21 of the hysteresis brake 20 by means of the magnetic force of the hysteresis brake 20. The gear mechanism 13 is not illustrated explicitly here either. The pivoting movement of the locking element 27 is indicated by an arrow on the locking element 27 (FIG. 3*a*). FIG. 3*b* shows an exterior view of the hysteresis brake 20 without the gear mechanism 13. The locking element 27 is fastened to the rotor 22 by a fastening element 29, which is formed by a leaf spring, and can be disengaged by means of the spring force of the leaf spring. A projection 28 which reaches around or above the stator 21 of the hysteresis brake 20 is situated on the upper side of the locking element 27. This is illustrated more clearly in a detailed illustration in FIG. 3*c*. Introduction of magnetic flux is therefore improved, and a magnetic force acting on the locking element 27 is increased. The hysteresis band 23 is provided in the region of the locking element 27 with a cutout 26, so that the magnetic flux at this point has to pass predominantly through the locking element 27. The locking element 27 can be pivoted about an axis of rotation 30. In FIG. 3*c*, the locking element 27 is depicted in its unlocked position.

Figure 4:
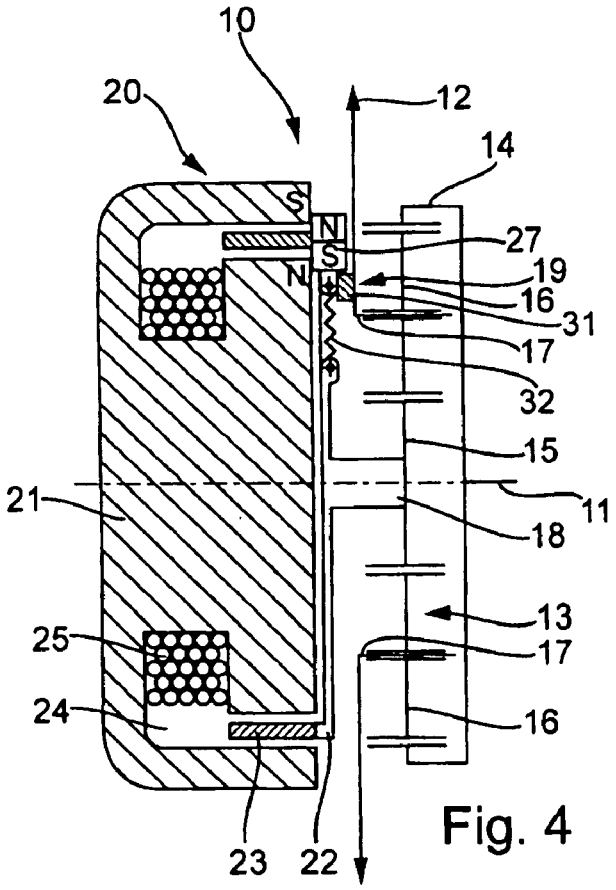
FIG. 4 shows a locking element partially formed from permanently magnetic material, in the unlocked position.

In all preceding and following exemplary embodiments, the locking element 27 can be at least partially formed from a permanently magnetic material or can be entirely composed of a permanently magnetic material, as FIG. 4 shows. The polarity of the locking element 27 can be selected here to be opposed to the polarity of the stator 21 of the hysteresis brake 20. The force effect of the permanently magnetic material reduces the electric current in the coil 25 of the hysteresis brake 20, which current is required in order to hold the locking element 27 in the unlocked position.

Figure 5:
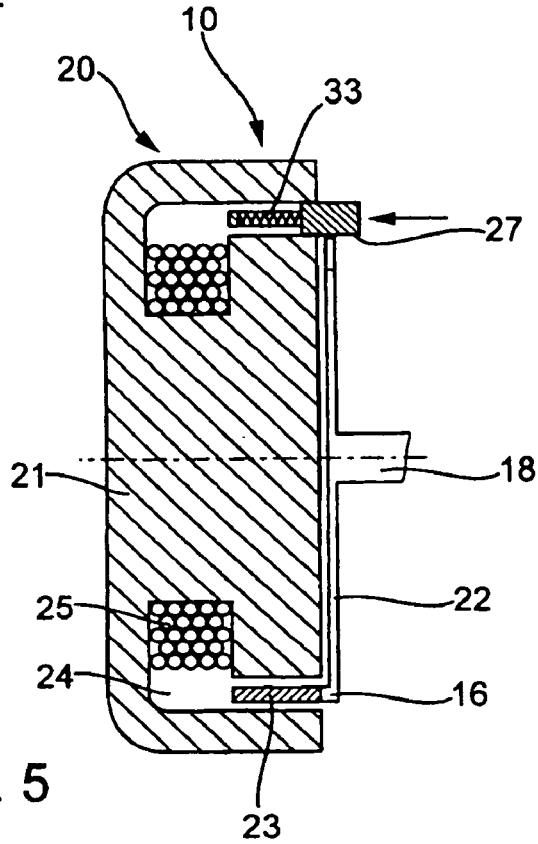
FIG. 5 shows a locking element, which is mounted displaceably in the axial direction, with a restoring spring, FIGS. 6*a,* 6*b* show an arrangement of a locking element, which is mounted such that it can be displaced radially by means of a separate solenoid, in the locked position (a) and unlocked position (b)

In a further preferred embodiment according to FIG. 5, the locking element 27 is mounted displaceably within the stator gap 24, which is provided with the pole structure (not illustrated) of the hysteresis brake 20. In this arrangement, the locking element 27, which is mounted displaceably in the rotor 22, can be drawn into the stator gap 24 by the magnetic force of the coil 25. This corresponds to the unlocked position of the locking element 27. When the coil 25 is energized at too low a level or not at all, a restoring spring 33 presses the locking element 27 axially outward in order to lock the camshaft adjusting device 10. The gear mechanism 13 is not explicitly depicted in this figure.

Figure 6A:
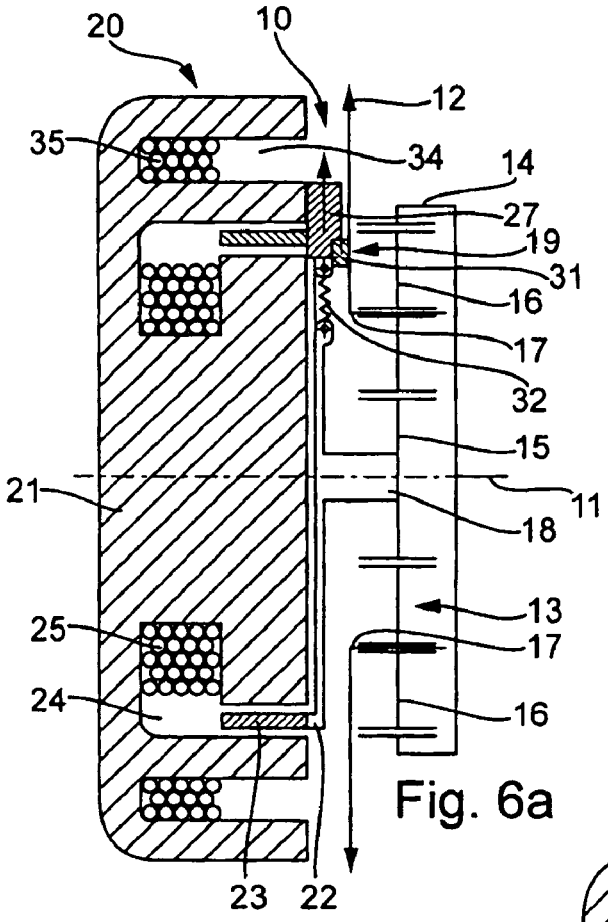
Figure 6B:
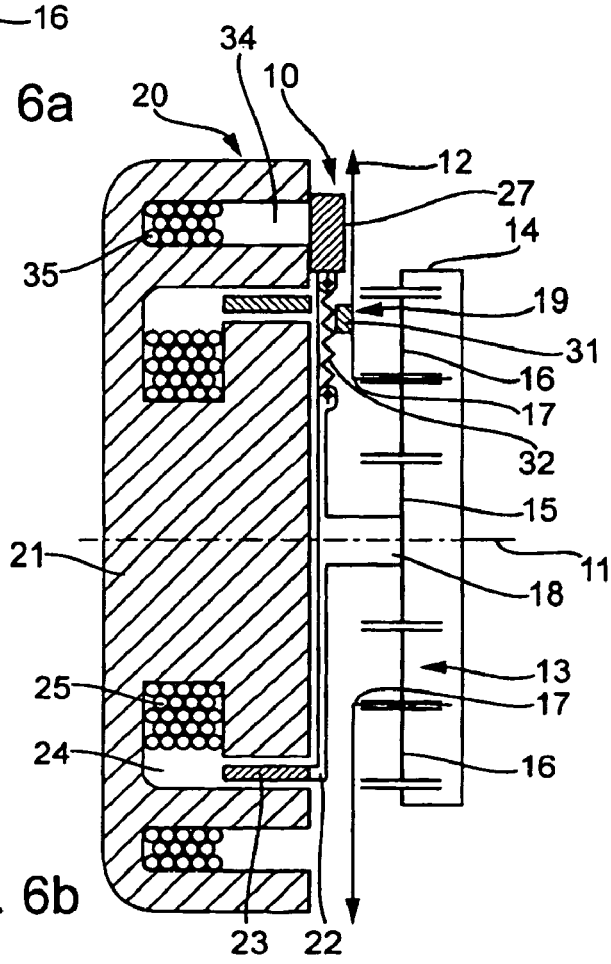

FIGS. 6*a* and 6*b* show an embodiment wherein the locking element 27 can be actuated with the aid of a separate solenoid 35. The solenoid 35 is integrated in the stator 21 of the hysteresis brake 20 and is arranged with its coil in a radially outside the coil 25 of the hysteresis brake 20. FIG. 6*a* shows the locking element 27 in its locked position. The locking element 27 is also situated radially outside the coil 25. If the coil of the solenoid 35 is energized, the locking element 27 moves radially outward, as indicated by the upwardly directed arrow on the locking element 27, into its unlocked position, which can be seen in FIG. 6*b*. In its unlocked position, the locking element 27 is pushed over the stator gap 34 of the separate solenoid 35 and is held there until the magnetic force thereof is lower than the spring force of the restoring spring 32.

Figure 7:
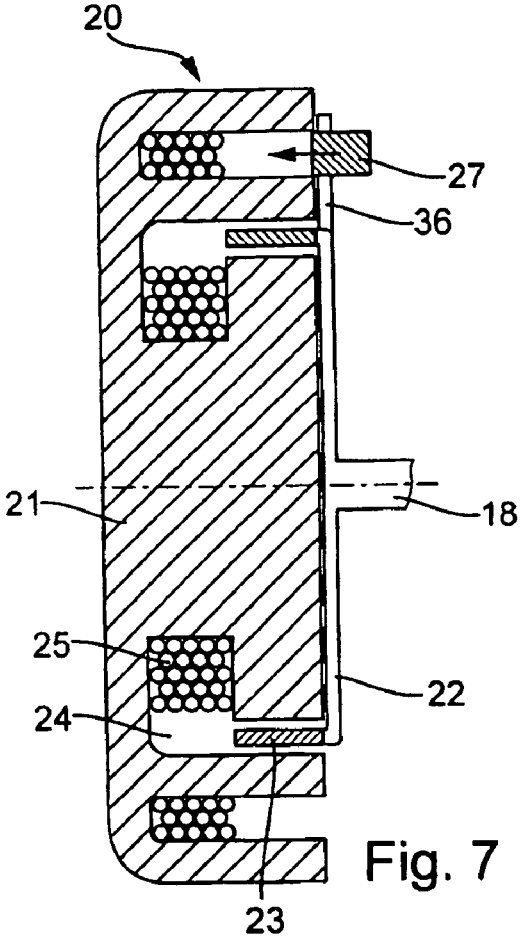
FIG. 7 shows an arrangement of a locking element, which is mounted such that it can be displaced axially by means of a separate solenoid.

FIG. 7 shows the situation with an axially displaceable locking element 27 in a refinement with a separate solenoid 35 corresponding to the exemplary embodiment of FIG. 6. The gear mechanism 13 is not explicitly depicted in this figure. The locking element 27 is mounted in an axially displaceable manner in a radially outer extension 36 of the rotor 22 and, when the solenoid 35 is energized, can be drawn into the stator gap 34 thereof. Means (not illustrated) are expediently provided in order, if the energization of the solenoid 35 is at too low a level or is absent, to press the locking element 27 axially out of the stator gap 34 into its locking position.

Figure 8:
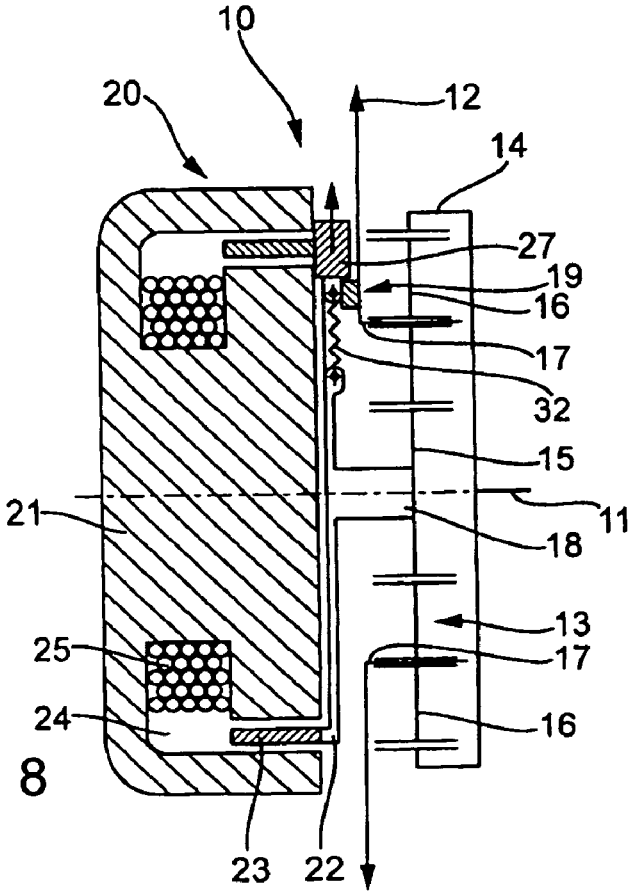
FIG. 8 shows an arrangement of a locking element, which is mounted such that it can be displaced radially by means of centrifugal force.

FIG. 8 shows another embodiment wherein the locking element 27 is arranged in such a manner that it is moveable radially by the action of centrifugal force, as indicated by a radially outwardly pointing arrow on the locking element 27. A magnetic force of the hysteresis brake 20 for moving the locking element 27 can be assisted by the centrifugal force of the rotor 22, which likewise acts in the radial direction. If unlocking is only to take place when a certain rotational speed is exceeded locking occurs when the rotational speed falls below a certain value. Given a corresponding configuration a magnetic force assistance is not needed.

What is claimed is:

1. A camshaft adjusting device for adjusting a phase position of a camshaft (11) of an internal combustion engine relative to a crankshaft, comprising at least an output which is the camshaft (11), a drive input (12), a control input (18), and a gear mechanism (13) via which the output and inputs are interconnected, and a locking element (27) with which at least two of the at least three output and inputs (11, 12, 18) can be locked to one another in a rotationally fixed manner depending on operating conditions, the locking element (27) connecting the control input (18) of the gear mechanism (13) to the camshaft (11) in a rotationally fixed manner.

2. The camshaft adjusting device as claimed in claim 1, including a control input (18), wherein the locking element (27) connects the control input (18) of the gear mechanism (13) to the drive input (12) in a rotationally fixed manner.

3. The camshaft adjusting device as claimed in claim 1, wherein the locking element (27) connects the drive input (12) of the camshaft (11) to the camshaft (11) in a rotationally fixed manner.

4. The camshaft adjusting device as claimed in claim 1, wherein the locking element (27) is mounted to one of the output and inputs, so that it is movable into a catch (31) of the other of the output and inputs for locking the adjusting device in a latching position.

5. The camshaft adjusting device as claimed in claim 1, wherein the locking element (27) is at least partially formed from a magnetic material.

6. The camshaft adjusting device as claimed in claim 1, wherein the locking element (27) is at least partially formed from a permanently magnetic material.

7. The camshaft adjusting device as claimed in claim 1, wherein a plurality of latching points (19) are provided for the locking.

8. The camshaft adjusting device as claimed in claim 7, including a number of latching points, wherein a particular latching point (19) is selectable depending on operating conditions.

9. The camshaft adjusting device as claimed claim 1, wherein the locking element (27) is movable radially between a locking position and an unlocking position.

10. The camshaft adjusting device as claimed in claim 1, wherein the locking element (27) is movable in an axial direction between a locking position and an unlocking position.

11. The camshaft adjusting device as claimed in claim 1, wherein the locking element (27) is supported so as to be pivotable about a pivot joint (30) between a locking position and an unlocking position.

12. The camshaft adjusting device as claimed in claim 1, wherein a restoring spring (32) is provided for moving the locking element (27) from an unlocking position into a locking position.

13. The camshaft adjusting device as claimed in claim 1 including a hysteresis brake (20) for holding the locking element (27) in an unlocking position by a magnetic flux of the hysteresis brake (20).

14. The camshaft adjusting device as claimed in claim 13, wherein a solenoid (35) is provided for actuating the locking element (27).

15. The camshaft adjusting device as claimed in claim 14, wherein, the hysteresis brake (28) includes an annular hysteresis band (23) mounted on a rotor (22), the solenoid (35) being arranged radially outside the hysteresis band (23) of the hysteresis brake (20).

16. The camshaft adjusting device as claimed in claim 15, wherein the solenoid (35) and the hysteresis brake (20) have a common electric power supply.

17. The camshaft adjusting device as claimed in claim 1, wherein the locking element (27) is arranged in such a manner that it is moveable radially by centrifugal forces.

18. The camshaft adjusting device as claimed in claim 15, wherein the locking element (27) is connected to a rotor (22) of a hysteresis brake (22) in a rotationally fixed manner.

19. The camshaft adjusting device as claimed in claim 1, wherein the locking element (27) is latched in place when the internal combustion engine is switched off, thereby blocking the camshaft adjusting device.

* * * * *